US008365706B2

(12) United States Patent
Grunwald

(10) Patent No.: US 8,365,706 B2
(45) Date of Patent: Feb. 5, 2013

(54) METHOD AND DEVICE FOR TESTING THE TIGHTNESS OF A FUEL TANK OF AN INTERNAL COMBUSTION ENGINE

(75) Inventor: Oliver Grunwald, Ingolstadt (DE)

(73) Assignee: Audi AG, Ingolstadt (DE)

( * ) Notice: Subject to any disclaimer, the term of this patent is extended or adjusted under 35 U.S.C. 154(b) by 552 days.

(21) Appl. No.: 12/545,916

(22) Filed: Aug. 24, 2009

(65) Prior Publication Data

US 2010/0095747 A1 Apr. 22, 2010

(30) Foreign Application Priority Data

Aug. 22, 2008 (DE) ..... 10 2008 039 300

(51) Int. Cl.
*F02M 37/20* (2006.01)
*F02M 25/08* (2006.01)

(52) U.S. Cl. ..... 123/516; 73/114.39

(58) Field of Classification Search ..... 123/516, 123/518, 519, 520; 73/114.38, 114.39
See application file for complete search history.

(56) References Cited

U.S. PATENT DOCUMENTS 4,962,744 A * 10/1990 Uranishi et al. ..... 123/520
5,263,462 A * 11/1993 Reddy ..... 123/520
6,321,727 B1 * 11/2001 Reddy et al. ..... 123/520
6,327,901 B1 * 12/2001 Dawson et al. ..... 73/114.39
6,550,316 B1 * 4/2003 Wong et al. ..... 73/49.7
6,626,032 B2 * 9/2003 Fabre et al. ..... 73/114.39
6,722,189 B2 * 4/2004 Fabre ..... 73/114.39
6,769,290 B2 * 8/2004 Fabre ..... 73/49.7
7,086,276 B2 * 8/2006 Cook et al. ..... 73/40.5 R
7,194,893 B2 * 3/2007 Cook et al. ..... 73/40.5 R
7,448,367 B1 11/2008 Reddy et al.
2002/0011094 A1 1/2002 Cook et al.
2005/0126265 A1 6/2005 Herzog et al.
2005/0224055 A1 * 10/2005 Wiese et al. ..... 123/494
2009/0211348 A1 * 8/2009 Meixner ..... 73/114.38
2010/0071672 A1 * 3/2010 Grunwald et al. ..... 123/520
2010/0101541 A1 * 4/2010 Grunwald et al. ..... 123/518
2011/0079298 A1 * 4/2011 Eser ..... 137/488

FOREIGN PATENT DOCUMENTS

DE 102006056384 A1 6/2008

* cited by examiner

*Primary Examiner* — Thomas Moulis
(74) *Attorney, Agent, or Firm* — Novak Druce + Quigg LLP

(57) ABSTRACT

The invention relates to a method and a device for testing the tightness of a fuel tank of an internal combustion engine, in particular of a vehicle, with a pressure switch which communicates with the interior of the fuel tank, and a diagnosis means for testing the serviceability of the pressure switch by evaluating the switching status of the pressure switch. So that diagnosis of the pressure switch is possible even with the internal combustion engine shut off or the vehicle turned off and for internal combustion engines with exhaust gas turbochargers, it is proposed, according to the invention, that the diagnosis means test the opening behavior of the pressure switch when the temperature rises.

8 Claims, 2 Drawing Sheets

METHOD AND DEVICE FOR TESTING THE TIGHTNESS OF A FUEL TANK OF AN INTERNAL COMBUSTION ENGINE

The invention relates to a method and a device for testing the tightness of a fuel tank of an internal combustion engine.

BACKGROUND OF THE INVENTION

To prevent fuel or fuel vapors from fuel tanks of motor vehicles from escaping into the environment, it is mandatory in many states that the tightness of these fuel tanks be monitored. For this purpose a pressure switch is often used whose switching status indicates that a given switching pressure in the fuel tank itself or in the fuel tank ventilation means is exceeded or not reached.

For example, U.S. Pat. No. 5,263,462 discloses a method in which by using such a pressure switch and a temperature sensor it is ascertained whether as a result of cooling of the tank ventilation means after shutting off of the internal combustion engine within the tank ventilation means a natural underpressure forms which leads to closing of the pressure switch.

Furthermore, DE 10 2006 045 678 A1 discloses a device of the initially mentioned type in which the tank ventilation means in addition to the pressure switch comprises a fuel vapor storage tank which communicates with the interior of the fuel tank and a controllable tank ventilation valve which is located between the storage tank and the intake manifold of the internal combustion engine, and a method of the initially named type in which the serviceability of the tank ventilation means is assessed based on a comparison of the switching status of the pressure switch before and after opening of the tank ventilation valve.

In all methods and devices in which a pressure switch is used for ascertaining leaks of a fuel tank, however, proper operation of the pressure switch must always be guaranteed since in a defect or malfunction of the pressure switch reliable monitoring of the tightness of the fuel tank is no longer guaranteed. For this reason it is even required by law in some states that proper operation of the pressure switch be tested or monitored.

In known methods and devices for testing the tightness of a fuel tank of an internal combustion engine, the proper operation of the pressure switch is usually tested in a so-called coasting phase of an engine control device of the internal combustion engine in which the crankshaft of the internal combustion engine is no longer turning, the electronics and, in particular, the engine control device, however, are still fully serviceable. As is described, for example, in DE 10 2006 045 678 A1, advantageously for this test the controllable tank ventilation valve in the connecting line between the storage tank for the fuel vapors and the intake manifold of the internal combustion engine is open, the switching status of the pressure switch being detected before and after opening of the tank ventilation valve. When the pressure switch is closed before opening of the tank ventilation valve as a result of a negative pressure in the fuel tank, and opens when the tank ventilation valve opens as a result of the pressure rise during venting, it is diagnosed as free of faults. When the pressure switch conversely does not open, it is diagnosed as faulty.

This known method, however, has two major disadvantages. On the one hand, it can be carried out only during operation of the internal combustion engine and during the coasting phase of the engine control device, but not while the internal combustion engine or a vehicle equipped with the internal combustion engine, in particular a motor vehicle, is shut off. On the other hand, the method is not suited for internal combustion engines with exhaust gas turbochargers, since in the connecting line which discharges upstream from the compressor of the exhaust gas turbocharger into the intake manifold and which leads from the storage tank for the fuel vapors to the intake manifold, in addition to the tank ventilation valve a check valve is also installed which prevents backflow into the fuel tank and thus its venting by way of the tank ventilation valve.

On this basis the object of the invention is to improve a method and a device of the initially mentioned type such that even with the internal combustion engine shut off or the vehicle shut down and for internal combustion engines with an exhaust gas turbocharger, diagnosis of the pressure switch is possible.

SUMMARY OF THE INVENTION

This object is achieved, according to the invention, with respect to the method in that for diagnosis of the serviceability of the pressure switch its opening behavior is tested when the temperature rises, while with respect to the device it is proposed, according to the invention, that the diagnosis means test the opening behavior of the pressure switch when the temperature rises.

By means of the measure according to the invention the diagnosis of the serviceability of the pressure switch can be done not only during operation of the internal combustion engine and directly afterwards, but also a still longer time after shutting off the internal combustion engine. Moreover, diagnosis in all the internal combustion engines of a family of internal combustion engines, i.e., internal combustion engines with and without a turbocharger, can be carried out in the same way.

One preferred configuration of the invention calls for the switch to be diagnosed as free of faults when it opens after the temperature and thus the pressure in the fuel tank and fuel system have risen by a predetermined amount, while, on the other hand, it is diagnosed as faulty when it does not open in this case.

Since engine control devices of internal combustion engines do not operate when diagnosis of the serviceability of the pressure switch is done after shutting off the internal combustion engine, the data collected in the diagnosis are preferably sent to the engine control device the next time the internal combustion engine is started for evaluation or for purposes of suitable measures such as display of a defect of the pressure switch on the instrument panel of the motor vehicle.

Since the pressure rise evaluated in the diagnosis process according to the invention in the fuel tank or in the fuel system as a result of the temperature rise only leads to a change of the switching status of the pressure switch when the pressure switch is closed at the start of the diagnosis process and displays a negative pressure in the fuel tank or fuel system, another advantageous embodiment of the invention calls for the diagnosis process to be initiated only when this condition is met.

Since in the diagnosis method according to the invention the change of the switching status of the pressure switch which is caused by the temperature-induced pressure rise in the fuel tank or fuel system is used for testing its serviceability, and the level of the pressure rise depends on the respective temperature change, preferably a starting temperature measured by the temperature sensor when the diagnosis process starts is stored and is compared to an actual temperature measured at regular time intervals by the temperature sensor.

If in this comparison the difference between the actual temperature and the stored starting temperature rises above a given positive threshold value, which would lead to a pressure rise which causes switchover of the pressure switch in a fuel tank or fuel system without a leak, according to another preferred configuration of the invention, the switching status of the pressure switch is tested in order to ascertain whether this switchover has also taken place.

When this is the case, the switch is diagnosed as free of faults, while the switch is diagnosed as faulty when the switching status has not changed after the difference between the actual temperature and the stored starting temperature has exceeded the given threshold value.

BRIEF DESCRIPTION OF THE INVENTION

DETAILED DESCRIPTION OF THE PREFERRED EMBODIMENTS OF THE INVENTION

Figure 1:
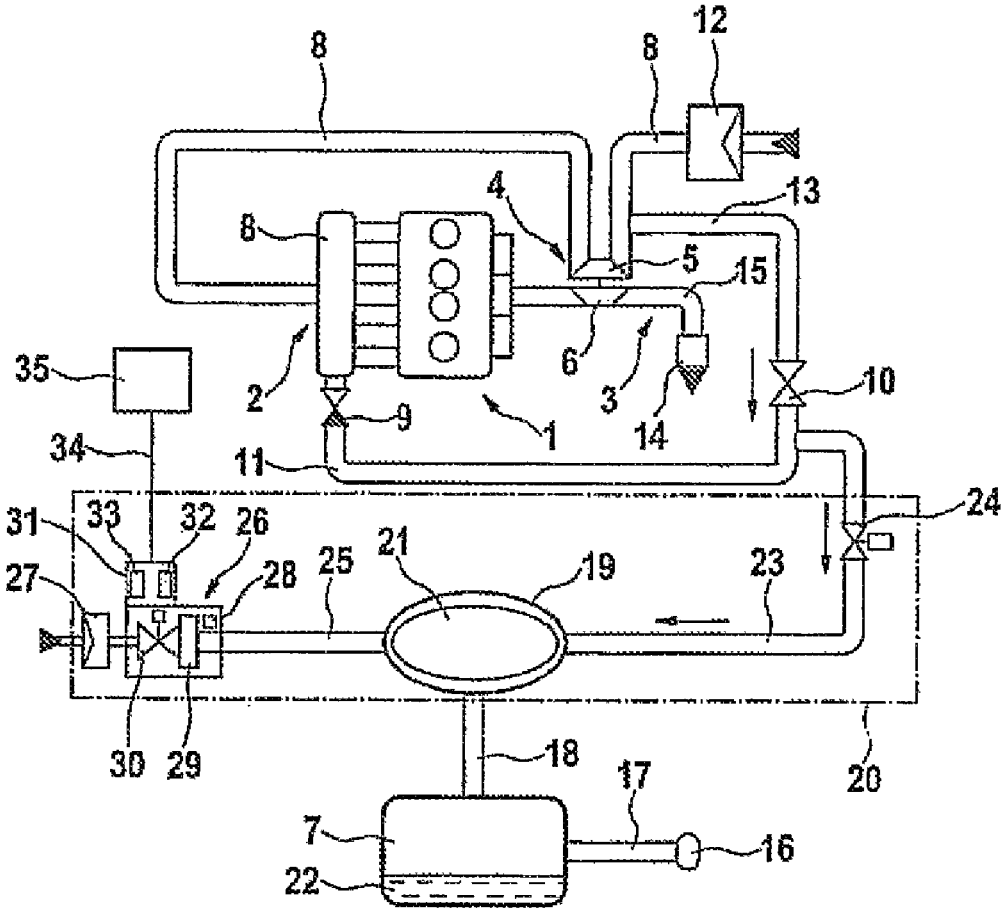
FIG. 1 shows a schematic of an internal combustion engine with an exhaust gas turbocharger for a motor vehicle with part of the intake and exhaust gas line and a fuel tank and a tank ventilation means.

The internal combustion engine 1 of a motor vehicle shown schematically in FIG. 1 comprises an intake line 2, an exhaust gas line 3 and the exhaust gas turbocharger 4 with a compressor 5 and a turbine 6 and is supplied with fuel from the fuel tank 7.

The intake line 2 of the internal combustion engine 1 comprises an intake manifold 8 which is connected to an air filter 12 both by way of the compressor 5 of the exhaust gas turbocharger 4 and also by way of a bypass line 11 which is provided with a bypass valve 9 and check valve 10. The bypass line 11 discharges by way of a suction scoop 13 into the part of the intake manifold 8 located between the air filter 12 and the compressor 5.

The exhaust gas line 3 comprises a tailpipe 15 which leads by way of the turbine 6 of the exhaust gas turbocharger 4 to the exhaust 14, as well as exhaust gas aftertreatment means (not shown).

The fuel tank 7 has a filler neck 17 closed by a tank cap 16 and is connected to a retaining tank 19 of the tank ventilation means 20 by way of a tank ventilation line 18. The retaining tank 19 contains an activated charcoal filter 21 which is used to capture fuel vapors which collect in the fuel tank 7 above the liquid fuel 22 and travel into the retaining tank 19 by way of the tank ventilation line 18.

For regeneration of the activated charcoal filter 21, the retaining tank 19 communicates by way of the regeneration line 23 and a controllable tank ventilation valve 24 in the regeneration line 23 with the bypass line 11 into which the regeneration line 23 discharges between the bypass valve 9 and the check valve 10. Furthermore, the retaining tank 19 is connected by way of a ventilation line 25 to a diagnosis module 26 which is used to test the tightness of the fuel tank 7 and other components of the fuel system, for example of the retaining tank 19.

The diagnosis module 26 communicates by way of an air filter 27 with the exterior and encompasses a temperature sensor 28 and a bistable pressure switch 29. The pressure switch 29 is open or closed depending on the pressure difference between the interior of the retaining tank 19 and the exterior and is located in a shutoff valve 30 between the air filter 27 and the ventilation line 25, said pressure switch being used conventionally to diagnosis leaks of the fuel system 7, 19. The pressure switch 29 is set such that it is closed when a negative pressure prevails within the fuel tank 7 and the retaining tank 19 with reference to the external environment, and that it opens when the pressure difference between the interior of the fuel tank 7 and of the retaining tank 19 on the one hand and the exterior on the other hand drops below a predetermined switching threshold of the pressure switch 29. The diagnosis module 26 furthermore comprises a central processor 31 which has a microprocessor 32 and a data memory 33 and is connected via a data line 34 to the engine control device 35 of the internal combustion engine 1.

Figure 2:
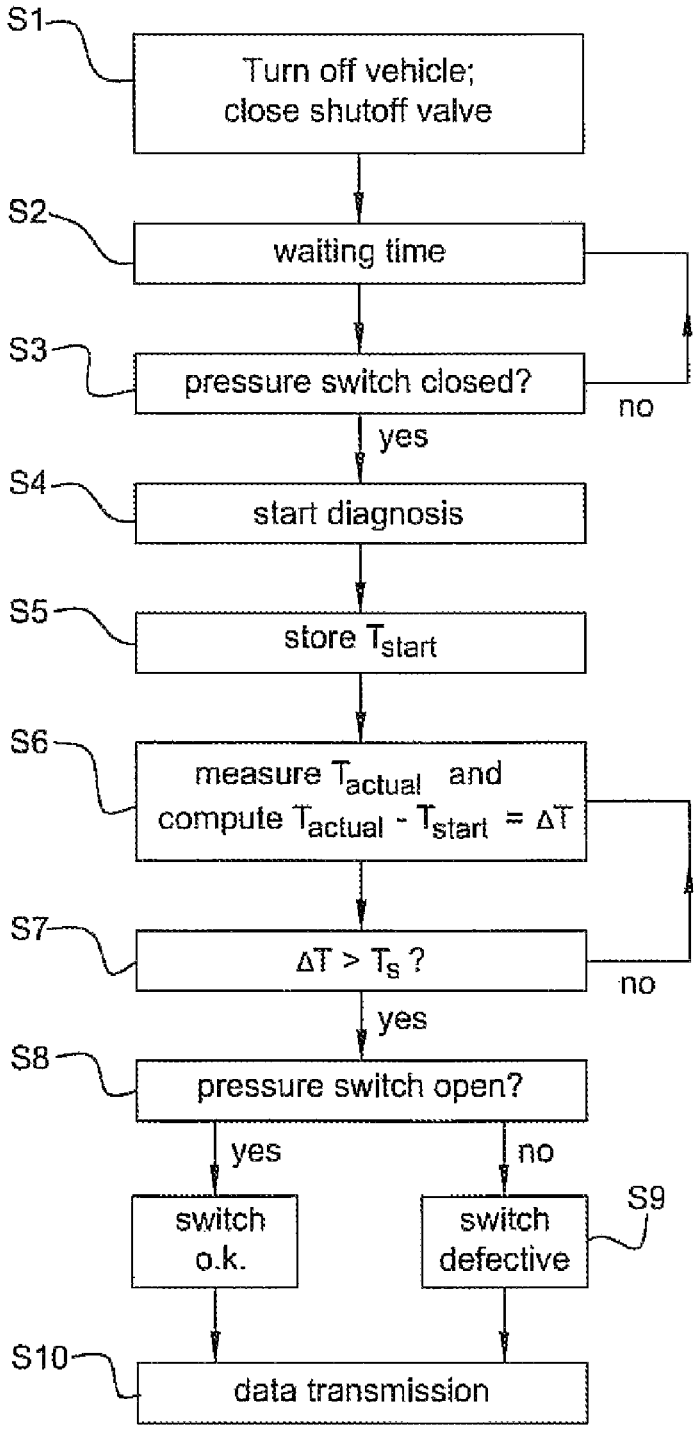
FIG. 2 shows a flow chart of the procedure in the testing or diagnosis of proper operation of a pressure switch of the tank ventilation means.

To prevent a situation in which a leak of the fuel system is not immediately detected as a result of a defective pressure switch 29, the pressure switch 29 must be regularly tested and monitored in order to ensure its proper operation. The procedure for executing this test is described below with reference to the flow chart shown schematically in FIG. 2.

In a first step S1, when the internal combustion engine 1 is turned off, the shutoff valve 30 in the diagnosis module 26 is closed there. After in a second step S2 passage of a given time interval which is sufficient for cooling of the fuel system 7, 19 has been awaited, in the third step S3, using the switching status of the pressure switch 29, it is tested whether it is closed, i.e., whether within the fuel tank 7 and the retaining tank 19 a negative pressure prevails or not. When it is ascertained in step S3 that the pressure switch 29 is open, there is a return to step S2 in order after a given time interval has transpired to test the switching status of the pressure switch 29 again in step S3. If it is ascertained in step S3 that the pressure switch 29 is closed, in the fourth step S4, the diagnosis of proper operation of the pressure switch 29 is started. Here, in a fifth step S5, the starting temperature $T_{start}$ measured at this instant by the temperature sensor 26 is first stored in the memory 33 of the central processor 31. In a sixth step S6, after a predetermined time interval since the start of diagnosis has passed, the actual temperature $T_{actual}$ measured by the temperature sensor 28 is compared to the starting temperature $T_{start}$ stored in the memory 33 of the central processor 31 and the difference $\Delta T$ between the actual temperature $T_{actual}$ and the stored starting temperature $T_{start}$ is computed. The computed temperature difference $\Delta T$ is then compared in seventh step S7 with a temperature threshold value $T_S$ which was computed beforehand and which was stored likewise in the memory 33 of the central processor 31, at which the pressure switch 29 in the case of a tight fuel system 7, 19 would have to open as a result of the temperature-induced pressure rise in the fuel system 7, 19. When the temperature difference $\Delta T$ in the comparison in step S7 is below the predetermined threshold value $T_S$, step S6 is repeated after a predetermined time interval. When the temperature difference $\Delta T$ is above a predetermined threshold value $T_S$ in the comparison in step S7, in the eighth step S8 the switching status of the pressure switch 29 is determined. When determination of the switching status of the pressure switch 29 results in that the latter is open, the pressure switch 29 is diagnosed as fault-free in a ninth step S9. When the determination of the switching status of the pressure switch 29 conversely results in that it is closed, the pressure switch 29 in step S9 is diagnosed as faulty.

In the last step S10 after restarting the internal combustion engine 1 all the data determined in the diagnosis are sent to the engine control device 35 of the internal combustion engine 1 which, in the case of a pressure switch 29 which is diagnosed as faulty, activates a corresponding display on the instrument panel of the motor vehicle.

The invention claimed is:

1. A method for testing the tightness of a fuel tank of an internal combustion engine, in which the switching status of a pressure switch which communicates with the interior of the fuel tank is evaluated, wherein for the diagnosis of the operability of the pressure switch its opening behavior is tested when a temperature of the fuel tank rises, wherein the pressure switch is diagnosed as free of faults if it opens after the temperature has risen by a predetermined amount, wherein the pressure switch is diagnosed as faulty if it does not open after the temperature has risen by a predetermined amount, and wherein the diagnosis is started only when the pressure switch is closed.

2. The method according to claim 1 wherein diagnosis of the serviceability of the pressure switch is done after the internal combustion engine is turned off and that the data collected in the diagnosis are sent to an engine control device of the internal combustion engine the next time the internal combustion engine is started.

3. The method according to claim 1, wherein a starting temperature ($T_{start}$) measured by the temperature sensor when the diagnosis process starts is stored.

4. The method according to claim 3, wherein the stored starting temperature ($T_{start}$) is compared to the actual temperature ($T_{actual}$) measured by the temperature sensor and the temperature difference ($\Delta T$) between the actual temperature ($T_{actual}$) and the stored starting temperature ($T_{start}$) is computed.

5. The method according to claim 4, wherein the switching status of the pressure switch is tested when the computed temperature difference ($\Delta T$) rises above a given positive threshold value ($T_S$).

6. The method according to claim 5, wherein the pressure switch is diagnosed as free of faults when its switching status has changed after the temperature difference ($\Delta T$) has risen above a given positive threshold value ($T_S$).

7. The method according to claim 5 wherein the pressure switch is diagnosed as faulty when its switching status has not changed after the temperature difference ($\Delta T$) has risen above a given positive threshold value ($T_S$).

8. A device for testing the tightness of a fuel tank of an internal combustion engine, the device comprising:

a pressure switch which communicates with the interior of the fuel tank, and a diagnosis means for testing the operability of the pressure switch, wherein the diagnosis means tests the opening behavior of the pressure switch (29) when a temperature of the fuel tank rises, wherein the diagnosis means is configured to diagnose the pressure switch as free of faults if it opens after the temperature of the fuel tank has risen by a predetermined amount, wherein the pressure switch is diagnosed as faulty if it does not open after the temperature of the fuel tank has risen by a predetermined amount, and wherein the diagnosis means is configured to start only when the pressure switch is closed.

* * * * *